US008365745B2

(12) United States Patent
Miles

(10) Patent No.: US 8,365,745 B2
(45) Date of Patent: Feb. 5, 2013

(54) EYELASH CURLER

(76) Inventor: Rudy Miles, New York, NY (US)

( * ) Notice: Subject to any disclaimer, the term of this patent is extended or adjusted under 35 U.S.C. 154(b) by 196 days.

(21) Appl. No.: 12/908,017

(22) Filed: Oct. 20, 2010

(65) Prior Publication Data

US 2012/0097181 A1 Apr. 26, 2012

(51) Int. Cl.
*A45D 40/24* (2006.01)

(52) U.S. Cl. ..... 132/217

(58) Field of Classification Search ..... 132/216, 132/217; D28/36

See application file for complete search history.

(56) References Cited

U.S. PATENT DOCUMENTS 2,444,310 A * 6/1948 Resnikoff et al. ..... 132/217
2,444,937 A * 7/1948 Marcellus ..... 132/217
2,893,404 A 7/1959 Flynn
4,719,931 A 1/1988 Suzuki
6,662,809 B2 12/2003 Yamaguchi et al.
7,207,337 B2 4/2007 Park
2011/0290271 A1 * 12/2011 Rabe et al. ..... 132/216

* cited by examiner

*Primary Examiner* — Rachel Steitz
(74) *Attorney, Agent, or Firm* — Michael L. Greenberg, Esq.; Greenberg & Lieberman, LLC

(57) ABSTRACT

An eyelash curler used to shape an upper eyelash so as to make it appear longer and more full. The eyelash curler employs a "roller system" that curls an upper eyelash, rather than a "pressing system" that bends or crimps an upper eyelash to achieve a curled effect as with conventional eyelash curlers. The forming members of the eyelash curler, in all the embodiments of the present invention, are cylindrical and curved like the upper eyelash line to help achieve curling, and are less likely than conventional eyelash curlers to damage an eyelash.

7 Claims, 3 Drawing Sheets

EYELASH CURLER

FIELD OF THE PRESENT INVENTION

The present invention relates to eyelash curlers, devices used to shape an upper eyelash so as to make it appear longer and more full. The present invention utilizes a "roller system" that curls the eyelash, rather than a "pressing system" that bends or crimps an upper eyelash to achieve a curled effect, as do conventional eyelash curlers. The forming members of the eyelash curler, in all the embodiments of the present invention, are cylindrical and curved like the upper eyelash line to help achieve curling, and are less likely than conventional eyelash curlers to damage an eyelash.

BACKGROUND OF THE PRESENT INVENTION

Eyelash curlers have been an important part of the beauty industry since they were first patented in 1931. That they have become an integral part of the beautifying process is demonstrated by a remark from pop star Cher, who once said that if she was allowed to take only one item to a desert island, she would take her eyelash curler. Numerous eyelash curlers have received patents throughout the years, and it would be impossible to list references to all or even most of them. However, most conventional eyelash curlers typically comprise a pair of forming members, one a stationary forming member and the other a moveable forming member, that crimp the upper eyelash. The moveable forming member of a conventional eyelash curler usually has fitted onto it a silicone pad, called a pressing strip, that molds the eyelash.

U.S. Pat. No. 4,719,931 issued to Kisaburo Suzuki on Jan. 19, 1988 is for an eyelash curler that utilizes forming members to bend the eyelash in conjunction with an electric heater and blower device. Suzuki's device differs from the present invention, which utilizes cylindrical, rounded forming members in order to curl the eyelashes with no need of a heater and blower device.

U.S. Pat. No. 2,893,404 issued to John V. Flynn on Jul. 7, 1959 is for an eyelash curler that utilizes a fixed forming member and a cushioned forming member that are levered together to bend the eyelash. Flynn's device differs from the present invention, which utilizes cylindrical, rounded forming members in order to curl the eyelash.

U.S. Pat. No. 7,207,337 issued to Il-Yong Park on Apr. 24, 2007 is for an eyelash curler in a molded plastic casing with a fixed forming member made of stainless steel, and a moveable forming member covered with an elastic material. Park's device differs from the present invention, which utilizes two curved, cylindrical forming members in order to curl the eyelash.

U.S. Pat. No. 6,662,809 issued to Naoki Yamaguchi et al. on Dec. 16, 2003 is for an eyelash curler that employs battery powered heaters to curl eyelashes. Yamaguchi's device differs from the present invention, which requires no heaters in order to curl eyelashes.

SUMMARY OF THE PRESENT INVENTION

The present invention is an eyelash curler designed to actually curl an upper eyelash rather than bend or crimp it. This goal is achieved through the design of the present invention's forming members, the forming members being the parts of the eyelash curler that shape the eyelash.

With conventional eyelash curlers, users get a crimped or bended, rather than curled, eyelash. This is inevitable considering the design of conventional eyelash curlers. Conventional eyelash curlers use two flat forming members to bend or crimp an eyelash at a right angle, which can damage the eyelash if a user is not careful. It is possible for conventional eyelash curlers to curl an eyelash, but in order to achieve a genuine curl, a special technique is required to move the forming members along the lash line. A licensed beautician is trained to employ this technique, but a user employing an eyelash curler at home would most likely be unfamiliar with how to achieve it. The forming members of the present invention, however, create a true curl in the eyelash, and this effect can be achieved by users untrained in beautician techniques. The present invention is thus less damaging to an eyelash than conventional eyelash curlers that bend or crimp the eyelash.

Furthermore, many women would like to use an eyelash curler after applying mascara to their eyelashes, but doing so can be hazardous with conventional eyelash curlers. Since mascara tends to dry out the eyelash, the right angle bending and crimping of a conventional eyelash curler can damage the eyelash hairs and even cause them to break off. However, because of the design of the present invention's forming members, a mascaraed eyelash will be gently curved rather than bent at a right angle. This gentle curving of the eyelash offers users the ability to curl their mascaraed eyelashes without doing damage to the eyelashes.

One embodiment of the present invention is comprised of two forming members, each forming member a curved cylinder made of plastic or aluminum or other non-porous substance that will not absorb mascara. The cylinders are curved and rounded like the upper eyelash line, and paired with a conventional eyelash curler handle. When the two forming members are brought together onto the user's upper eyelash, the eyelash gets curled from the pressure of the forming members on the eyelash.

In a second embodiment of the present invention that is also the preferred embodiment, there are also two curved and cylindrical forming members but the lower forming member has a roller that pivots on the lower forming member. The roller is cylindrical like the forming members, but made of a flexible, spongy material such as foam or silicone. When the user's upper eyelash is placed in between the forming members, and pressure is applied to the conventional handle, the forming members come together and the roller on the lower forming member pivots in order to curl the eyelash.

In a third embodiment of the present invention, there are also two cylindrical and curved forming members, each of them with a roller that pivots on the forming member. The rollers are cylindrical like the forming members, but made of a flexible, spongy material such as silicone. When the user's upper eyelash is placed in between the forming members, and pressure is applied to the conventional handle, the forming members come together and the rollers on the upper and lower forming members pivot in order to curl the eyelash.

In each of the above embodiments, the forming members are cylindrical and curved so it is not necessary to repeatedly press the present invention against the eyelash to get desired results. This makes the present invention different from existing lash curlers that require multiple pressing movements, increasing the risk of injury to the eye and eyelashes.

DETAILED DESCRIPTION OF THE PRESENT INVENTION

The present invention is an eyelash curler that utilizes forming members to genuinely curl an eyelash rather than bend or crimp it. The forming members are the aspect of the present invention that makes it different from previous eyelash curlers.

With conventional eyelash curlers, the eyelash is bended or crimped at a right angle that can damage the eyelash if a user is not careful. A licensed beautician is trained to achieve a genuine curl using conventional eyelash curlers by employing a special technique to move the eyelash curler along the eyelash line, but a user employing an eyelash curler at home would most likely be unfamiliar with how to achieve this genuine curl. The present invention, however, because of the shape of its forming members, creates a genuine curl in the eyelash without the need of a beautician's professional skill. Users can employ the present invention to achieve a genuinely curled eyelash without the risk of damaging the eyelash by bending or crimping it at a 90 degree angle, as do conventional eyelash curlers. Below are descriptions of three embodiments of the present invention, each one illustrated by a figure.

Figure 1:
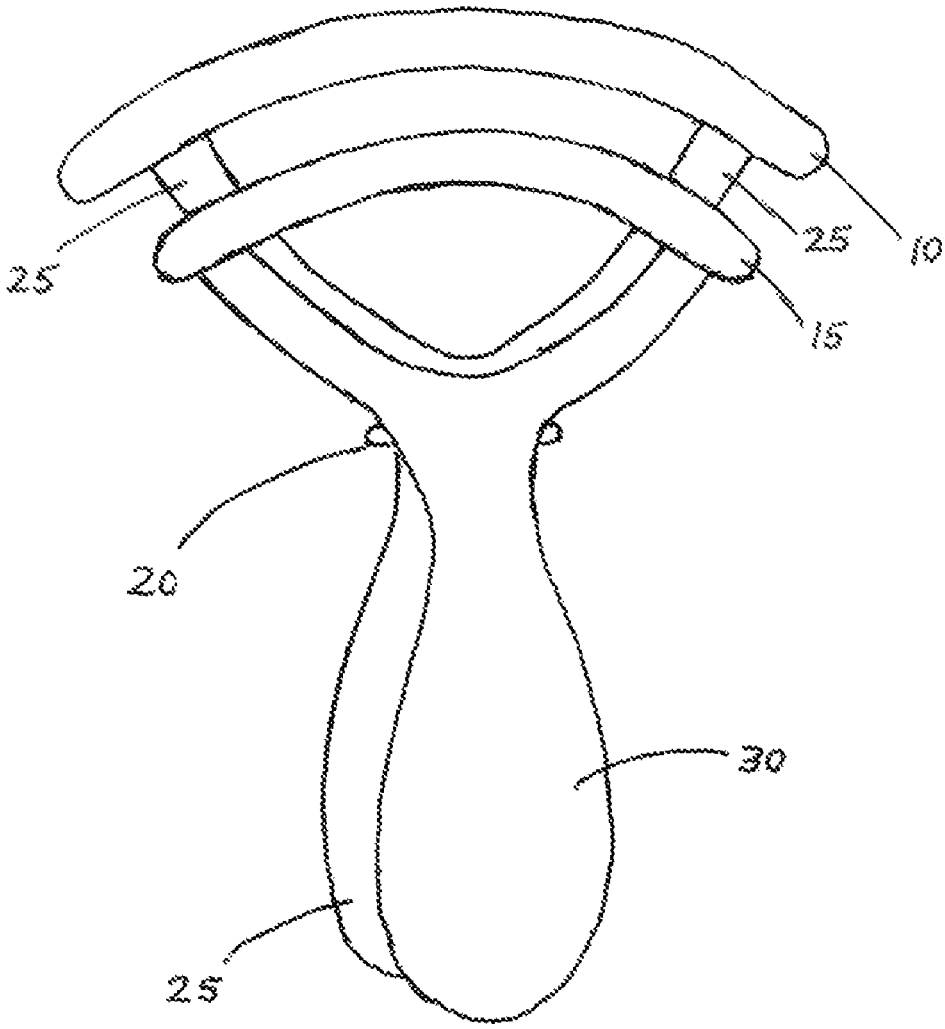
FIG. 1 shows a front view of one embodiment of the present invention.

One embodiment of the present invention is shown in FIG. 1. In this embodiment there are two forming members (10 and 15), the first forming member (10) and the second forming member (15), designed to produce a curl on the eyelash. The forming members (10 and 15) are cylindrical and curved like the upper eyelash line in order to achieve a curl on the eyelash when they are pressed together. The first forming member (10) is connected to a first handle (25) and the second forming member (15) is connected to a second handle (30), the handles (25 and 30) interlocked by conventional means and with a conventional spring mechanism (20) placed between them. In order to curl the eyelash, the user places the eyelash in the gap between the forming members (10 and 15) and applies pressure to the handles (25 and 30). This application of pressure causes the second forming member (15) to press against both the eyelash and the first forming member (10), and curl the eyelash. The spring mechanism (20) releases the second forming member (15) from the eyelash and the first forming member (10) when the user releases pressure from the handles (25 and 30). The handles (25 and 30) are envisioned as made of molded plastic or aluminum as with conventional eyelash curler handles.

The forming members (10 and 15) shown in FIG. 1 are made of plastic, aluminum or other non-porous materials. The non-porousness is necessary so that the forming members (10 and 15) will not absorb mascara. Many women would like to use an eyelash curler after applying mascara to their eyelashes, but doing so can be hazardous with conventional eyelash curlers. Since mascara tends to dry out an eyelash, the right angle bending and crimping of a conventional eyelash curler can damage the eyelash hairs and even cause them to break off. However, the design of the present invention offers a way around this problem. Because of the design of the forming members (10 and 15), a mascaraed eyelash will be gently curved rather than bent at a right angle as with conventional eyelash curlers. This gentle curving of the eyelash offers users the ability to curl their mascaraed eyelashes without doing damage to the eyelashes.

Figure 2:
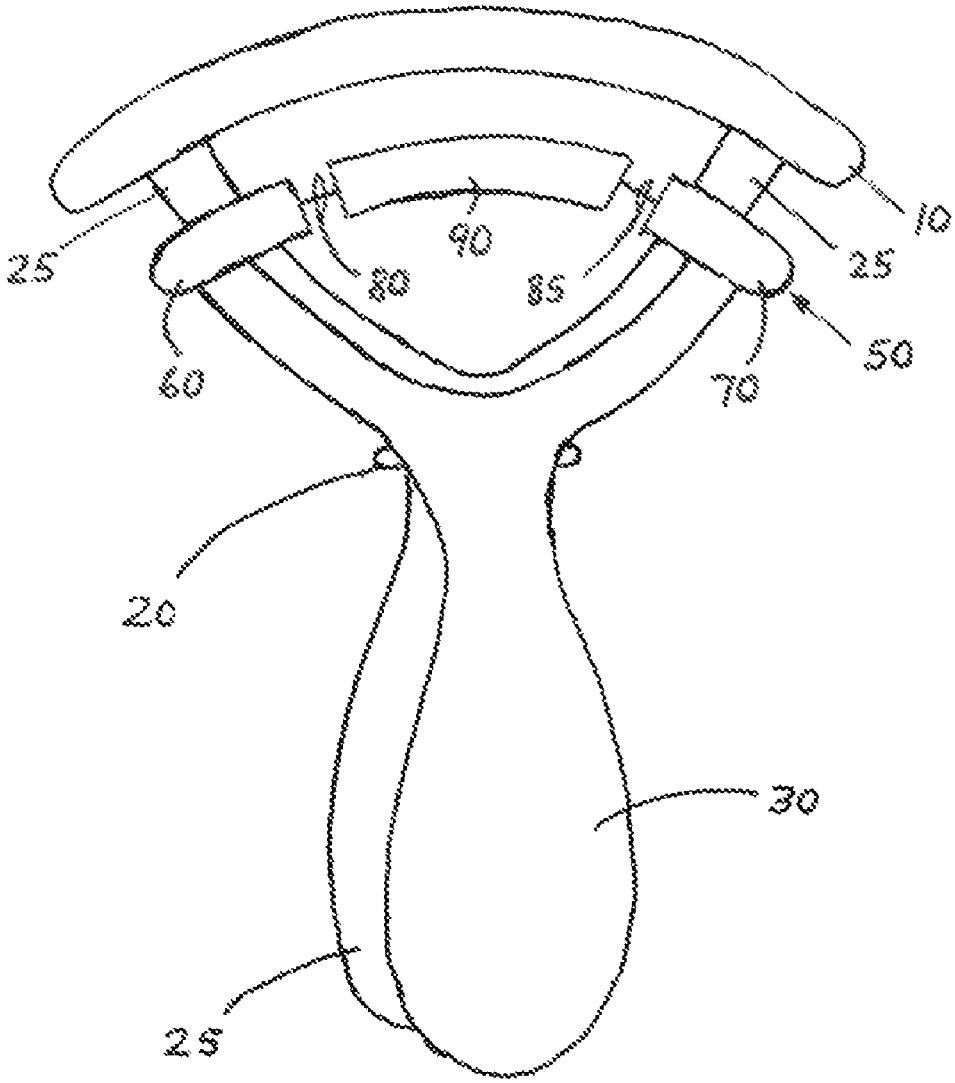
FIG. 2 shows a front view of a second embodiment of the present invention.

FIG. 2 shows a second embodiment of the present invention, which is also the preferred embodiment of the present invention. The second embodiment utilizes the first forming member (10) and a third forming member (50) in order to place a curl on the eyelash. The forming members (10 and 50) are cylindrical and curved in order to achieve a curl on the eyelash when they are pressed together. The first forming member (10) is connected to a first handle (25) and the third forming member (50) is connected to a second handle (30), with the first handle (25) and second handle (30) interlocked by conventional means and with a conventional spring mechanism (20) placed between them. The first forming member (10), as in the first embodiment of the present invention, is made of plastic, aluminum or other non-porous materials. The third forming member (50), however, is more complex in design than the first forming member (10). The third forming member (50) is comprised of a first end piece (60) and a second end piece (70), the end pieces (60 and 70) being the third forming member's (50) points of connection to the second handle (30). Issuing out of the center of the first end piece (60) is a first prong (80), and issuing out of the center of the second end piece (70) is a second prong (85). A first roller (90) is mounted on the first prong (80) and second prong (85). The first roller (90) is a cylinder of flexible material such as foam or silicone and is designed to pivot on the prongs (80 and 85). In order to curl an eyelash, the user places the eyelash in the gap between the forming members (10 and 50) and applies pressure to the handles (25 and 30), causing the third forming member (50) to press against both the eyelash and first forming member (10). When the forming members (10 and 50) come together, the first roller (90) will pivot on the prongs (80 and 85), pushing up against the eyelash and curling it. The spring mechanism (20) releases the forming members (10 and 50) from the eyelash when the user releases pressure from the handles (25 and 30). This method of curling the eyelash makes it unnecessary to repeatedly press the eyelash curler against the lashes to get desired results, unlike existing lash curlers requiring multiple pressing movements that increase the risk of injury to the user's eyelash and eye. The first handle (25) and second handle (30) are envisioned as made of molded plastic or aluminum.

Figure 3:
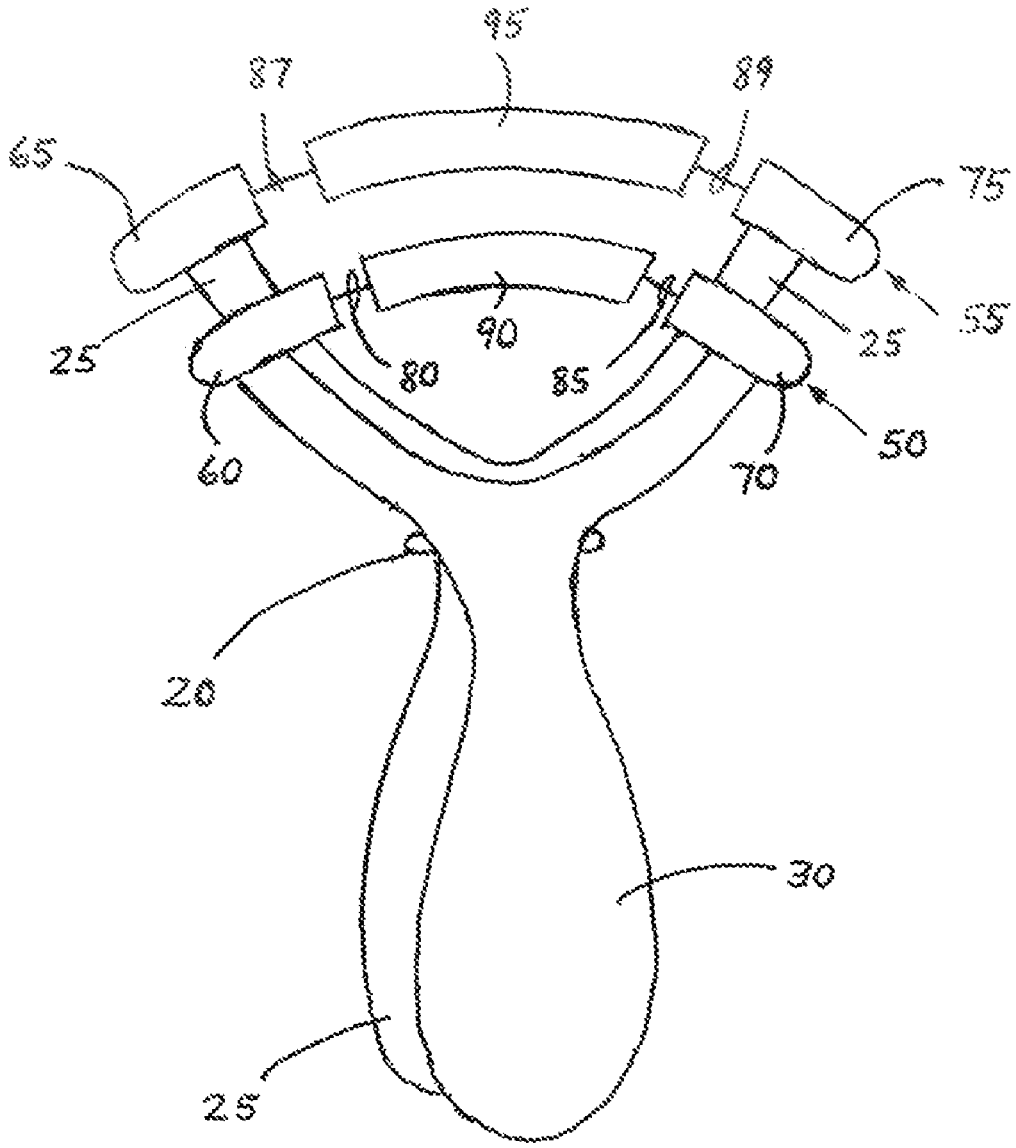
FIG. 3 shows a front view of a third embodiment of the present invention.

FIG. 3 shows a third embodiment of the present invention. The third embodiment utilizes the third forming member (50) and a fourth forming member (55) in order to place a curl on the eyelash. The forming members (50 and 55) are cylindrical and curved in order to achieve a curl on the eyelash when they are pressed together. The fourth forming member (55) is connected to the first handle (25) and the third forming member (50) is connected to the second handle (30), with the first handle (25) and second handle (30) interlocked by conventional means and with a conventional spring mechanism (20) placed between them. The first handle (25) and second handle (30) are envisioned as made of molded plastic or aluminum. The third forming member (50) is composed of a first end piece (60) and a second end piece (70), the end pieces (60 and 70) being the third forming member's (50) points of connection to the second handle (30). Issuing out of the center of the first end piece (60) is a first prong (80), and issuing out of the center of the second end piece (70) is a second prong (85). A first roller (90) is mounted on the first prong (80) and second prong (85). The first roller (90) is a cylinder of flexible material such as foam or silicone and designed to pivot on the prongs (80 and 85). The fourth forming member (55) is composed of a third end piece (65) and a fourth end piece (75), the end pieces (65 and 75) being the fourth forming member's (55) points of connection to the first handle (25). Issuing out of the center of the third end piece (65) is a third prong (87), and issuing out of the center of the fourth end piece (75) is a fourth prong (89). A second roller (95) is mounted on the third prong (87) and fourth prong (89). The second roller (90) is a cylinder of flexible material such as foam or silicone and designed to pivot on the prongs (87 and 89). In order to curl an eyelash, the user places the eyelash in the gap between the forming members (50 and 55) and applies pressure to the handles (25 and 30), causing the third forming member (50) to press against both the eyelash and the fourth forming member (55). When the forming members (50 and 55) come together, both the first roller (90) and second roller (95) will pivot, pushing up against the eyelash and curling it. The spring mechanism (20) releases the forming members (50 and 55) from the eyelash when the user releases pressure from the handles (25 and 30). This method of curling the eyelash makes it unnecessary to repeatedly press the eyelash curler against the eyelash to get desired results, unlike existing lash curlers requiring multiple pressing movements that increase the risk of injury to the user's eyelash and eye.

In summary, the present invention is an eyelash curler, comprising a first forming member (10) made of non-porous material, the first forming member (10) being a curved cylinder; a second forming member (15) made of non-porous material, the second forming member (15) being a curved cylinder; a first handle (25) disposed on the first forming member (10); a second handle (30) disposed on the second forming member (15); wherein the first handle (25) and the second handle (30) are interlocked; a spring mechanism (20) between the first handle (25) and the second handle (30); and the first handle (25) and the second handle (30) configured to move towards one another. In addition, the first forming member (10) is disposed at a first end on the first handle, the second forming member (15) is disposed at a second end on the second handle (30), the first forming member (10) is configured to remain stationary relative to the first handle, and the second forming member (15) is configured to remain stationary relative to the second handle (30).

Furthermore, the preferred embodiment of the present invention is an eyelash curler comprising a first forming member (10) made of non-porous material, the first forming member (10) being a curved cylinder; a third forming member (50) being a curved cylinder, the third forming member (50) configured with a first roller (90); a first handle (25) disposed on the first forming member (10); a second handle (30) disposed on the third forming member (50); wherein the first handle (25) and the second handle (30) are interlocked; a spring mechanism (20) between the first handle (25) and the second handle (30); the first handle (25) and the second handle (30) configured to move towards one another; wherein the third forming member (50) comprises a first end piece (60), a second end piece (70), a first prong (80), a second prong (85), and the first roller (90); wherein the first roller (90) is mounted on the first prong (80) and the second prong (85); wherein the first roller (90) is configured to rotate on the first prong (80) and the second prong (85); and wherein the second handle (30) connects to the third forming member (50) at the first end piece (60) and the second end piece (70).

Finally, the third embodiment of the present invention is an eyelash curler comprising a third forming member (50) being a curved cylinder, the third forming member (50) configured with a first roller (90); a fourth forming member (55) being a curved cylinder, the fourth forming member (55) configured with a second roller (95); a first handle (25) disposed on the fourth forming member (55); a second handle (30) disposed on the third forming member (50); wherein the first handle (25) and the second handle (30) are interlocked; a spring mechanism (20) between the first handle (25) and the second handle (30); the first handle (25) and the second handle (30) configured to move towards one another; the third forming member (50) comprising a first end piece (60), a second end piece (70), a first prong (80), a second prong (85), and the first roller (90); the first roller (90) mounted on the first prong (80) and the second prong (85); the first roller (90) configured to rotate on the first prong (80) and the second prong (85); the second handle (30) connecting to the third forming member (50) at the first end piece (60) and the second end piece (70); wherein the fourth forming member (55) comprises a third end piece (65), a fourth end piece (75), a third prong (87), a fourth prong (89), and the second roller (95); wherein the second roller (95) is mounted on the third prong (87) and the fourth prong (89); and wherein the second roller (95) rotates on the third prong (87) and the fourth prong (89).

Having illustrated the present invention, it should be understood that various adjustments and versions might be implemented without venturing away from the essence of the present invention. The present invention is not limited to the embodiments described above, and should be interpreted as any and all embodiments within the scope of the following claims.

The invention claimed is:

1. An eyelash curler, comprising:

a first forming member of non-porous material, said first forming member being a curved cylinder;

a second forming member being a curved cylinder, said second forming member configured with a first roller;

a first handle disposed on said first forming member;

a second handle disposed on said second forming member;

wherein said first handle and said second handle are interlocked;

a spring mechanism between said first handle and said second handle;

said first handle and said second handle configured to move towards one another;

wherein said second forming member comprises a first end piece, a second end piece, a first prong, a second prong, and said first roller;

wherein said first roller is mounted on said first prong and said second prong; and wherein said first roller is configured to rotate on said first prong and said second prong.

2. The eyelash curler of claim 1, wherein said second handle connects to said second forming member at said first end piece and said second end piece.

3. An eyelash curler, comprising:

a first forming member being a curved cylinder, said first forming member configured with a first roller;

a second forming member being a curved cylinder, said second forming member configured with a second roller;

a first handle disposed on said second forming member;

a second handle disposed on said first forming member;

wherein said first handle and said second handle are interlocked;

a spring mechanism between said first handle and said second handle; and said first handle and said second handle configured to move towards one another;

wherein said first forming member comprises a first end piece, a second end piece, a first prong, a second prong, and said first roller;

wherein said first roller is mounted on said first prong and said second prong; and wherein said first roller is configured to rotate on said first prong and said second prong.

4. The eyelash curler of claim 3, wherein said second handle connects to said first forming member at said first end piece and said second end piece.

5. The eyelash curler of claim 4, wherein said second forming member comprises a third end piece, a fourth end piece, a third prong, a fourth prong, and said second roller.

6. The eyelash curler of claim 5, wherein said second roller is mounted on said third prong and said fourth prong.

7. The eyelash curler of claim 6, wherein said second roller rotates on said third prong and said fourth prong.

* * * * *